US011752391B2

(12) United States Patent
Arn et al.

(10) Patent No.: US 11,752,391 B2
(45) **Date of Patent: *Sep. 12, 2023**

(54) SYSTEM, METHOD AND APPARATUS FOR ADJUSTABLE PEDAL CRANK

(71) Applicant: ROM TECHNOLOGIES, INC., Brookfield, CT (US)

(72) Inventors: Peter Arn, Roxbury, CT (US); Nick Samiotes, Mashpee, MA (US); Paul DiCesare, Shelton, CT (US); Danial Ferreira, Woodbridge, CT (US)

(73) Assignee: ROM Technologies, Inc., Brookfield, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/537,001

(22) Filed: Nov. 29, 2021

(65) Prior Publication Data

US 2022/0080256 A1 Mar. 17, 2022

Related U.S. Application Data

(63) Continuation of application No. 16/812,462, filed on Mar. 9, 2020, now Pat. No. 11,185,735.

(Continued)

(51) Int. Cl.
*A63B 22/06* (2006.01)
*A63B 23/04* (2006.01)

(52) U.S. Cl.
CPC ..... *A63B 22/0605* (2013.01); *A63B 23/0476* (2013.01); *A63B 2022/0623* (2013.01)

(58) Field of Classification Search
CPC ..... A63B 22/0605; A63B 23/0476; A63B 2022/0623; A63B 21/00181;

(Continued)

(56) References Cited

U.S. PATENT DOCUMENTS 59,915 A 11/1866 Lallement
363,522 A 5/1887 Knous (Continued)

FOREIGN PATENT DOCUMENTS

CN 2885238 Y 4/2007
CN 202220794 U 5/2012

(Continued)

OTHER PUBLICATIONS

Davenport et al., "The Potential for Artificial Intelligence in Healthcare", 2019, Future Healthcare Journal 2019, vol. 6, No. 2: Year: 2019, pp. 1-5.

(Continued)

*Primary Examiner* — Andrew S Lo
*Assistant Examiner* — Andrew M Kobylarz
(74) *Attorney, Agent, or Firm* — Dickinson Wright PLLC; Stephen A. Mason; Jonathan H. Harder

(57) ABSTRACT

A pedal assembly for an exercise and rehabilitation device can include a disk having an axis of rotation. A central aperture can be formed in the disk along the axis. Spokes can extend radially from adjacent the central aperture toward a perimeter of the disk. The disk can be formed from a first material. In addition, a crank can be coupled to one of the spokes of the disk. The crank can have a hub concentric with the central aperture. Pedal apertures can extend along a radial length of the crank. The crank can be formed from a metallic material that differs from the first material. A pedal having a spindle can be interchangeably and releasably mounted to the pedal apertures in the crank.

18 Claims, 7 Drawing Sheets

Related U.S. Application Data

(60) Provisional application No. 62/816,531, filed on Mar. 11, 2019.

(58) Field of Classification Search
CPC ..... A63B 71/0622; A63B 21/4034; A63B 2209/00; A63B 2210/50; A61H 1/0237; A61H 2201/0192; A61H 2205/12; A61H 2201/164; A61H 2201/0157; A61H 2205/06; A61H 2205/065; A61H 2205/10; A61H 2201/1671; A61H 1/00
See application file for complete search history.

(56) References Cited

U.S. PATENT DOCUMENTS 446,671 A 2/1891 Elliot
610,157 A 8/1898 Campbell
631,276 A 8/1899 Bulova
823,712 A 6/1906 Uhlmann
1,149,029 A 8/1915 Clark
1,227,743 A 5/1917 Burgedorff
1,784,230 A 12/1930 Freeman
3,081,645 A 3/1963 Bergfors
3,100,640 A 8/1963 Weitzel
3,137,014 A 6/1964 Meucci
3,143,316 A 8/1964 Shapiro
3,713,438 A 1/1973 Knutsen
3,744,480 A 7/1973 Gause et al.
3,888,136 A 6/1975 Lapeyre
4,079,957 A 3/1978 Blease
4,408,613 A 10/1983 Relyea
4,436,097 A 3/1984 Cunningham
4,446,753 A 5/1984 Nagano
4,477,072 A 10/1984 DeCloux
4,499,900 A 2/1985 Petrofsky et al.
4,509,742 A 4/1985 Cones
4,606,241 A 8/1986 Fredriksson
4,611,807 A 9/1986 Castillo
4,616,823 A 10/1986 Yang
4,648,287 A 3/1987 Preskitt
4,673,178 A 6/1987 Dwight
4,822,032 A 4/1989 Whitmore et al.
4,824,104 A 4/1989 Bloch
4,850,245 A 7/1989 Feamster et al.
4,858,942 A 8/1989 Rodriguez
4,869,497 A 9/1989 Stewart et al.
4,915,374 A 4/1990 Watkins
4,930,768 A 6/1990 Lapcevic
4,932,650 A 6/1990 Bingham et al.
4,961,570 A 10/1990 Chang
5,137,501 A 8/1992 Mertesdorf
5,161,430 A * 11/1992 Febey ..... B62M 3/02 74/594.1
5,202,794 A 4/1993 Schnee et al.
5,240,417 A 8/1993 Smithson et al.
5,247,853 A 9/1993 Dalebout
5,256,115 A 10/1993 Scholder et al.
5,256,117 A 10/1993 Potts et al.
D342,299 S 12/1993 Birrell et al.
5,282,748 A 2/1994 Little
5,284,131 A 2/1994 Gray
5,316,532 A 5/1994 Butler
5,324,241 A 6/1994 Artigues et al.
5,336,147 A 8/1994 Sweeney, III
5,338,272 A 8/1994 Sweeney, III
5,361,649 A 11/1994 Slocum, Jr.
D353,421 S 12/1994 Gallivan
5,458,022 A 10/1995 Mattfeld et al.
5,487,713 A 1/1996 Butler
5,566,589 A * 10/1996 Buck ..... B62M 3/02 403/104
5,580,338 A 12/1996 Scelta et al.
5,676,349 A 10/1997 Wilson
5,685,804 A 11/1997 Whan-Tong et al.
5,738,636 A 4/1998 Saringer et al.
5,860,941 A 1/1999 Saringer et al.
5,950,813 A 9/1999 Hoskins et al.
6,007,459 A 12/1999 Burgess
6,053,847 A 4/2000 Stearns et al.
6,077,201 A 6/2000 Cheng
6,102,834 A 8/2000 Chen
6,110,130 A 8/2000 Kramer
6,155,958 A 12/2000 Goldberg
D438,580 S 3/2001 Shaw
6,253,638 B1 7/2001 Bermudez
6,267,735 B1 7/2001 Blanchard et al.
D450,100 S 11/2001 Hsu
D450,101 S 11/2001 Hsu
D451,972 S 12/2001 Easley
D452,285 S 12/2001 Easley
D454,605 S 3/2002 Lee
6,371,891 B1 4/2002 Speas
D459,776 S 7/2002 Lee
6,430,436 B1 8/2002 Richter
6,436,058 B1 8/2002 Krahner et al.
6,474,193 B1 11/2002 Farney
6,491,649 B1 12/2002 Ombrellaro
6,543,309 B2 4/2003 Heim
D475,424 S 6/2003 Lee
6,589,139 B1 * 7/2003 Butterworth ..... B62M 3/02 74/594.1
6,613,000 B1 9/2003 Reinkensmeyer et al.
D482,416 S 11/2003 Yang
6,640,662 B1 11/2003 Baxter
6,652,425 B1 11/2003 Martin et al.
D484,931 S 1/2004 Tsai
6,820,517 B1 11/2004 Farney
6,865,969 B2 3/2005 Stevens
6,895,834 B1 5/2005 Baatz
7,063,643 B2 6/2006 Arai
7,156,780 B1 1/2007 Fuchs et al.
7,204,788 B2 4/2007 Andrews
7,226,394 B2 6/2007 Johnson
RE39,904 E 10/2007 Lee
D575,836 S 8/2008 Hsiao
7,507,188 B2 3/2009 Nurre
7,594,879 B2 9/2009 Johnson
7,628,730 B1 12/2009 Watterson et al.
7,833,135 B2 11/2010 Radow et al.
7,837,472 B1 11/2010 Elsmore et al.
7,955,219 B2 6/2011 Birrell et al.
7,988,599 B2 8/2011 Ainsworth et al.
8,038,578 B2 10/2011 Olrik et al.
8,079,937 B2 12/2011 Bedell et al.
8,298,123 B2 10/2012 Hickman
8,371,990 B2 2/2013 Shea
8,419,593 B2 4/2013 Ainsworth et al.
8,465,398 B2 6/2013 Lee et al.
8,506,458 B2 8/2013 Dugan
8,556,778 B1 10/2013 Dugan
8,613,689 B2 12/2013 Dyer et al.
8,672,812 B2 3/2014 Dugan
8,784,273 B2 7/2014 Dugan
8,864,628 B2 10/2014 Boyette et al.
8,979,711 B2 3/2015 Dugan
9,044,630 B1 6/2015 Lampert et al.
D744,050 S 11/2015 Colburn
9,248,071 B1 2/2016 Benda et al.
9,272,185 B2 3/2016 Dugan
9,283,434 B1 3/2016 Wu
9,312,907 B2 4/2016 Auchinleck et al.
9,367,668 B2 6/2016 Flynt et al.
9,409,054 B2 8/2016 Dugan
9,480,873 B2 11/2016 Chuang
9,481,428 B2 11/2016 Gros et al.
9,566,472 B2 2/2017 Dugan
9,629,558 B2 4/2017 Yuen et al.
9,713,744 B2 7/2017 Suzuki
D793,494 S 8/2017 Mansfield et al.
D794,142 S 8/2017 Zhou
9,717,947 B2 8/2017 Lin
9,737,761 B1 8/2017 Govindarajan
9,782,621 B2 10/2017 Chiang et al.
9,802,076 B2 10/2017 Murray et al.

(56) References Cited

U.S. PATENT DOCUMENTS 9,914,053 B2 3/2018 Dugan
9,937,382 B2 4/2018 Dugan
9,977,587 B2 5/2018 Mountain
10,089,443 B2 10/2018 Miller et al.
10,155,134 B2 12/2018 Dugan
10,159,872 B2 12/2018 Sasaki et al.
10,173,094 B2 * 1/2019 Gomberg ..... A63B 69/16
10,173,095 B2 1/2019 Gomberg et al.
10,173,096 B2 1/2019 Gomberg et al.
10,173,097 B2 1/2019 Gomberg et al.
10,226,663 B2 3/2019 Gomberg et al.
10,569,122 B2 2/2020 Johnson
10,576,331 B2 3/2020 Kuo
10,625,114 B2 4/2020 Ercanbrack
10,646,746 B1 5/2020 Gomberg et al.
D907,143 S 1/2021 Ach et al.
10,918,332 B2 2/2021 Belson et al.
11,040,238 B2 6/2021 Colburn
11,069,436 B2 7/2021 Mason et al.
11,071,597 B2 7/2021 Posnack et al.
11,075,000 B2 7/2021 Mason et al.
D928,635 S 8/2021 Hacking et al.
11,087,865 B2 8/2021 Mason et al.
11,101,028 B2 8/2021 Mason et al.
11,107,591 B1 8/2021 Mason
11,139,060 B2 10/2021 Mason et al.
11,185,735 B2 11/2021 Arn et al.
D939,644 S 12/2021 Ach et al.
D940,797 S 1/2022 Ach et al.
11,229,727 B2 1/2022 Tatonetti
11,272,879 B2 3/2022 Wiedenhoefer et al.
11,282,599 B2 3/2022 Mason et al.
11,282,604 B2 3/2022 Mason et al.
11,282,608 B2 3/2022 Mason et al.
11,284,797 B2 3/2022 Mason et al.
D948,639 S 4/2022 Ach et al.
11,295,848 B2 4/2022 Mason et al.
11,309,085 B2 4/2022 Mason et al.
11,317,975 B2 5/2022 Mason et al.
11,325,005 B2 5/2022 Mason et al.
11,328,807 B2 5/2022 Mason et al.
11,337,648 B2 5/2022 Mason
11,348,683 B2 5/2022 Guaneri et al.
11,404,150 B2 8/2022 Guaneri et al.
11,410,768 B2 8/2022 Mason et al.
11,508,482 B2 11/2022 Mason et al.
11,515,021 B2 11/2022 Mason
11,515,028 B2 11/2022 Mason
11,541,274 B2 1/2023 Hacking
2002/0072452 A1 6/2002 Torkelson
2002/0143279 A1 10/2002 Porter et al.
2002/0160883 A1 10/2002 Dugan
2003/0036683 A1 2/2003 Kehr et al.
2003/0045402 A1 3/2003 Pyle
2003/0064863 A1 4/2003 Chen
2003/0092536 A1 5/2003 Romanelli et al.
2003/0109814 A1 6/2003 Rummerfield
2003/0181832 A1 9/2003 Carnahan et al.
2004/0102931 A1 5/2004 Ellis et al.
2004/0106502 A1 6/2004 Sher
2004/0147969 A1 7/2004 Mann et al.
2004/0172093 A1 9/2004 Rummerfield
2004/0194572 A1 10/2004 Kim
2005/0015118 A1 1/2005 Davis et al.
2005/0020411 A1 1/2005 Andrews
2005/0043153 A1 2/2005 Krietzman
2005/0049122 A1 3/2005 Vallone et al.
2005/0085346 A1 4/2005 Johnson
2005/0085353 A1 4/2005 Johnson
2005/0274220 A1 12/2005 Reboullet
2006/0003871 A1 1/2006 Houghton et al.
2006/0046905 A1 3/2006 Doody, Jr. et al.
2006/0199700 A1 9/2006 LaStayo et al.
2006/0247095 A1 11/2006 Rummerfield
2007/0042868 A1 2/2007 Fisher et al.
2007/0137307 A1 6/2007 Gruben et al.
2007/0173392 A1 7/2007 Stanford
2007/0287597 A1 12/2007 Cameron
2008/0021834 A1 1/2008 Holla et al.
2008/0096726 A1 4/2008 Riley et al.
2008/0153592 A1 6/2008 James-Herbert
2008/0161166 A1 7/2008 Lo
2009/0011907 A1 1/2009 Radow et al.
2009/0058635 A1 3/2009 LaLonde et al.
2009/0211395 A1 8/2009 Mule
2009/0270227 A1 10/2009 Ashby et al.
2010/0048358 A1 2/2010 Tchao et al.
2010/0121160 A1 5/2010 Stark et al.
2010/0173747 A1 7/2010 Chen et al.
2010/0248899 A1 9/2010 Bedell et al.
2010/0248905 A1 9/2010 Lu
2010/0298102 A1 11/2010 Bosecker et al.
2011/0172059 A1 7/2011 Watterson et al.
2011/0195819 A1 8/2011 Shaw et al.
2011/0275483 A1 11/2011 Dugan
2012/0116258 A1 5/2012 Lee
2012/0167709 A1 * 7/2012 Chen ..... B62M 3/02
74/594.2
2012/0190502 A1 7/2012 Paulus et al.
2012/0232438 A1 9/2012 Cataldi et al.
2013/0137550 A1 5/2013 Skinner et al.
2013/0178334 A1 7/2013 Brammer
2013/0345025 A1 12/2013 van der Merwe
2014/0011640 A1 1/2014 Dugan
2014/0113768 A1 4/2014 Lin et al.
2014/0155129 A1 6/2014 Dugan
2014/0172460 A1 6/2014 Kohli
2014/0194250 A1 7/2014 Reich et al.
2014/0194251 A1 7/2014 Reich et al.
2014/0207486 A1 7/2014 Carty et al.
2014/0246499 A1 9/2014 Proud et al.
2014/0256511 A1 9/2014 Smith
2014/0274565 A1 9/2014 Boyette et al.
2014/0274622 A1 9/2014 Leonhard
2014/0309083 A1 10/2014 Dugan
2015/0045700 A1 2/2015 Cavanagh et al.
2015/0094192 A1 4/2015 Skwortsow et al.
2015/0151162 A1 6/2015 Dugan
2015/0158549 A1 6/2015 Gros et al.
2015/0290061 A1 10/2015 Stafford et al.
2015/0360069 A1 12/2015 Marti et al.
2015/0379232 A1 12/2015 Mainwaring et al.
2016/0007885 A1 1/2016 Basta et al.
2016/0023081 A1 1/2016 Popa-Simil et al.
2016/0151670 A1 6/2016 Dugan
2016/0166881 A1 6/2016 Ridgel et al.
2016/0317869 A1 11/2016 Dugan
2016/0322078 A1 11/2016 Bose et al.
2016/0325140 A1 11/2016 Wu
2016/0332028 A1 11/2016 Melnik
2016/0361597 A1 12/2016 Cole et al.
2017/0014671 A1 1/2017 Burns
2017/0033375 A1 2/2017 Ohmori et al.
2017/0042467 A1 2/2017 Herr et al.
2017/0065851 A1 3/2017 Deluca et al.
2017/0080320 A1 3/2017 Smith
2017/0095692 A1 4/2017 Chang et al.
2017/0095693 A1 4/2017 Chang et al.
2017/0106242 A1 4/2017 Dugan
2017/0113092 A1 * 4/2017 Johnson ..... A63B 22/0015
2017/0128769 A1 5/2017 Long et al.
2017/0132947 A1 5/2017 Maeda et al.
2017/0168555 A1 6/2017 Munoz et al.
2017/0266501 A1 9/2017 Sanders et al.
2017/0282015 A1 10/2017 Wicks et al.
2017/0312614 A1 11/2017 Tran et al.
2017/0333755 A1 11/2017 Rider
2017/0337033 A1 11/2017 Duyan et al.
2017/0337334 A1 11/2017 Stanczak
2017/0368413 A1 12/2017 Shavit
2018/0017806 A1 1/2018 Wang et al.
2018/0036593 A1 2/2018 Ridgel et al.
2018/0056104 A1 3/2018 Cromie et al.
2018/0071565 A1 3/2018 Gomberg et al.

(56) References Cited

U.S. PATENT DOCUMENTS

2018/0071566 A1 3/2018 Gomberg et al.
2018/0071569 A1 3/2018 Gomberg et al.
2018/0071570 A1 3/2018 Gomberg et al.
2018/0071571 A1 3/2018 Gomberg et al.
2018/0071572 A1 3/2018 Gomberg et al.
2018/0078843 A1 3/2018 Tran et al.
2018/0085615 A1 3/2018 Astolfi et al.
2018/0096111 A1 4/2018 Wells et al.
2018/0116741 A1 5/2018 Garcia Kilroy et al.
2018/0177612 A1 6/2018 Trabish et al.
2018/0178061 A1 6/2018 O'larte et al.
2018/0200577 A1 7/2018 Dugan
2018/0228682 A1 8/2018 Bayerlein et al.
2018/0256079 A1 9/2018 Yang et al.
2018/0264312 A1 9/2018 Pompile et al.
2018/0272184 A1* 9/2018 Vassilaros ..... B62M 3/02
2018/0296157 A1 10/2018 Bleich et al.
2018/0326243 A1 11/2018 Badi et al.
2018/0330058 A1 11/2018 Bates
2018/0360340 A1 12/2018 Rehse et al.
2019/0031284 A1 1/2019 Fuchs
2019/0060708 A1 2/2019 Fung
2019/0076701 A1 3/2019 Dugan
2019/0091506 A1 3/2019 Gatelli et al.
2019/0111299 A1 4/2019 Radcliffe et al.
2019/0118038 A1 4/2019 Tana et al.
2019/0126099 A1 5/2019 Hoang
2019/0132948 A1 5/2019 Longinotti-Buitoni et al.
2019/0134454 A1 5/2019 Mahoney et al.
2019/0137988 A1 5/2019 Cella et al.
2019/0167988 A1 6/2019 Shahriar et al.
2019/0183715 A1 6/2019 Kapure et al.
2019/0200920 A1 7/2019 Tien et al.
2019/0209891 A1 7/2019 Fung
2019/0240103 A1 8/2019 Hepler et al.
2019/0240541 A1 8/2019 Denton et al.
2019/0244540 A1 8/2019 Errante et al.
2019/0275368 A1 9/2019 Maroldi
2019/0304584 A1 10/2019 Savolainen
2019/0307983 A1 10/2019 Goldman
2019/0354632 A1 11/2019 Mital et al.
2019/0366146 A1 12/2019 Tong et al.
2020/0005928 A1 1/2020 Daniel
2020/0051446 A1 2/2020 Rubinstein et al.
2020/0066390 A1 2/2020 Svendrys et al.
2020/0085300 A1 3/2020 Kwatra et al.
2020/0093418 A1 3/2020 Kluger et al.
2020/0151646 A1 5/2020 De La Fuente Sanchez
2020/0221975 A1 7/2020 Basta et al.
2020/0275886 A1 9/2020 Mason
2020/0289045 A1 9/2020 Hacking et al.
2020/0289046 A1 9/2020 Hacking et al.
2020/0289878 A1 9/2020 Arn et al.
2020/0289879 A1 9/2020 Hacking et al.
2020/0289880 A1 9/2020 Hacking et al.
2020/0289881 A1 9/2020 Hacking et al.
2020/0289889 A1 9/2020 Hacking et al.
2020/0357299 A1 11/2020 Patel et al.
2021/0076981 A1 3/2021 Hacking et al.
2021/0077860 A1 3/2021 Posnack et al.
2021/0101051 A1 4/2021 Posnack et al.
2021/0113890 A1 4/2021 Posnack et al.
2021/0127974 A1 5/2021 Mason et al.
2021/0128080 A1 5/2021 Mason et al.
2021/0128255 A1 5/2021 Mason et al.
2021/0134412 A1 5/2021 Guaneri et al.
2021/0134425 A1 5/2021 Mason et al.
2021/0134428 A1 5/2021 Mason et al.
2021/0134430 A1 5/2021 Mason et al.
2021/0134432 A1 5/2021 Mason et al.
2021/0134456 A1 5/2021 Posnack et al.
2021/0134457 A1 5/2021 Mason et al.
2021/0134458 A1 5/2021 Mason et al.
2021/0134463 A1 5/2021 Mason et al.
2021/0138304 A1 5/2021 Mason et al.
2021/0142875 A1 5/2021 Mason et al.
2021/0142893 A1 5/2021 Guaneri et al.
2021/0142898 A1 5/2021 Mason et al.
2021/0142903 A1 5/2021 Mason et al.
2021/0144074 A1 5/2021 Guaneri et al.
2021/0244998 A1 8/2021 Hacking et al.
2021/0245003 A1 8/2021 Turner
2021/0345879 A1 11/2021 Mason et al.
2021/0345975 A1 11/2021 Mason et al.
2021/0350888 A1 11/2021 Guaneri et al.
2021/0350898 A1 11/2021 Mason et al.
2021/0350899 A1 11/2021 Mason et al.
2021/0350901 A1 11/2021 Mason et al.
2021/0350902 A1 11/2021 Mason et al.
2021/0350914 A1 11/2021 Guaneri et al.
2021/0350926 A1 11/2021 Mason et al.
2021/0366587 A1 11/2021 Mason et al.
2021/0383909 A1 12/2021 Mason et al.
2021/0391091 A1 12/2021 Mason
2021/0398668 A1 12/2021 Chock et al.
2021/0407670 A1 12/2021 Mason et al.
2021/0407681 A1 12/2021 Mason et al.
2022/0015838 A1 1/2022 Posnack et al.
2022/0047921 A1 2/2022 Bissonnette et al.
2022/0079690 A1 3/2022 Mason et al.
2022/0105384 A1 4/2022 Hacking et al.
2022/0105385 A1 4/2022 Hacking et al.
2022/0115133 A1 4/2022 Mason et al.
2022/0118218 A1 4/2022 Bense et al.
2022/0126169 A1 4/2022 Mason
2022/0148725 A1 5/2022 Mason et al.
2022/0158916 A1 5/2022 Mason et al.
2022/0193491 A1 6/2022 Mason et al.
2022/0230729 A1 7/2022 Mason et al.
2022/0238223 A1 7/2022 Mason et al.
2022/0262483 A1 8/2022 Rosenberg et al.
2022/0266094 A1 8/2022 Mason et al.
2022/0270738 A1 8/2022 Mason et al.
2022/0273985 A1 9/2022 Jeong et al.
2022/0273986 A1 9/2022 Mason
2022/0288460 A1 9/2022 Mason
2022/0288461 A1 9/2022 Ashley et al.
2022/0288462 A1 9/2022 Ashley et al.
2022/0293257 A1 9/2022 Guaneri et al.
2022/0314075 A1 10/2022 Mason et al.
2022/0328181 A1 10/2022 Mason et al.
2022/0331663 A1 10/2022 Mason
2022/0339501 A1 10/2022 Mason et al.
2022/0384012 A1 12/2022 Mason
2022/0392591 A1 12/2022 Guaneri et al.
2022/0395232 A1 12/2022 Locke
2022/0415469 A1 12/2022 Mason
2022/0415471 A1 12/2022 Mason
2023/0013530 A1 1/2023 Mason
2023/0014598 A1 1/2023 Mason et al.
2023/0048040 A1 2/2023 Hacking et al.
2023/0051751 A1 2/2023 Hacking et al.
2023/0058605 A1 2/2023 Mason
2023/0060039 A1 2/2023 Mason
2023/0072368 A1 3/2023 Mason
2023/0078793 A1 3/2023 Mason
2023/0119461 A1 4/2023 Mason

FOREIGN PATENT DOCUMENTS

CN 103488880 A 1/2014
CN 104335211 A 2/2015
CN 105620643 A 6/2016
CN 105683977 A 6/2016
CN 103136447 B 8/2016
CN 105894088 A 8/2016
CN 105930668 A 9/2016
CN 106127646 A 11/2016
CN 106510985 A 3/2017
CN 107066819 A 8/2017
CN 107430641 A 12/2017
CN 107736982 A 2/2018
CN 108078737 A 5/2018
CN 208573971 U 3/2019

(56) References Cited

FOREIGN PATENT DOCUMENTS

| | | | |
|---|---|---|---|
| CN | 110148472 | A | 8/2019 |
| CN | 110215188 | A | 9/2019 |
| CN | 110808092 | A | 2/2020 |
| CN | 111105859 | A | 5/2020 |
| CN | 111370088 | A | 7/2020 |
| CN | 114203274 | A | 3/2022 |
| CN | 114898832 | A | 8/2022 |
| CN | 110270062 | B | 10/2022 |
| DE | 85019 | C | 1/1897 |
| DE | 3519150 | U1 | 10/1985 |
| DE | 3732905 | A1 | 7/1988 |
| DE | 19619820 | A1 | 12/1996 |
| DE | 29620008 | U1 | 2/1997 |
| DE | 19947926 | A1 | 4/2001 |
| EP | 199600 | A2 | 10/1986 |
| EP | 0383137 | A2 | 8/1990 |
| EP | 634319 | A2 | 1/1995 |
| EP | 1034817 | A1 | 9/2000 |
| EP | 2564904 | A1 | 3/2013 |
| EP | 2997951 | A1 | 3/2016 |
| EP | 3323473 | A1 | 5/2018 |
| EP | 3627514 | A1 | 3/2020 |
| EP | 3671700 | A1 | 6/2020 |
| FR | 2527541 | A2 | 12/1983 |
| GB | 141664 | A | 11/1920 |
| GB | 2336140 | A | 10/1999 |
| GB | 2372459 | A | 8/2002 |
| GB | 2512431 | A | 10/2014 |
| JP | 2005227928 | A | 8/2005 |
| JP | 2013515995 | A | 5/2013 |
| JP | 3198173 | U | 6/2015 |
| JP | 2019028647 | A | 2/2019 |
| JP | 6573739 | B1 | 9/2019 |
| KR | 20140128630 | A | 11/2014 |
| KR | 20150017693 | A | 2/2015 |
| KR | 20150078191 | A | 7/2015 |
| KR | 20160093990 | A | 8/2016 |
| KR | 20170038837 | A | 4/2017 |
| KR | 20190029175 | A | 3/2019 |
| KR | 20200029180 | A | 3/2020 |
| KR | 20230040526 | | 3/2023 |
| WO | 1998009687 | | 3/1998 |
| WO | 0149235 | A2 | 7/2001 |
| WO | 0151083 | A2 | 7/2001 |
| WO | 2006004430 | A2 | 1/2006 |
| WO | 2006012694 | A1 | 2/2006 |
| WO | 2008114291 | A1 | 9/2008 |
| WO | 2014163976 | A1 | 10/2014 |
| WO | 2016154318 | A1 | 9/2016 |
| WO | 2017091691 | A1 | 6/2017 |
| WO | 2017165238 | A1 | 9/2017 |
| WO | 2019022706 | A1 | 1/2019 |
| WO | 2020185769 | A1 | 3/2020 |
| WO | 2021021447 | A1 | 2/2021 |
| WO | 2021055427 | A1 | 3/2021 |
| WO | 2021055491 | A1 | 3/2021 |
| WO | 2021081094 | A1 | 4/2021 |
| WO | 2021138620 | A1 | 7/2021 |
| WO | 2021216881 | A1 | 10/2021 |
| WO | 2021236542 | A1 | 11/2021 |
| WO | 2021236961 | A1 | 11/2021 |
| WO | 2021262809 | A1 | 12/2021 |
| WO | 2022216498 | A1 | 10/2022 |
| WO | 2022251420 | A1 | 12/2022 |

OTHER PUBLICATIONS

Ahmed et al., "Artificial Intelligence With Multi-Functional Machine Learning Platform Development for Better Healthcare and Precision Medicine", 2020, Database (Oxford), 2020:baaa010. doi: 10.1093/database/baaa010 (Year: 2020), pp. 1-35.

Ruiz Ivan et al., "Towards a physical rehabilitation system using a telemedicine approach", Computer Methods in Biomechanics and Biomedical Engineering: Imaging & Visualization, vol. 8, No. 6, Jul. 28, 2020, pp. 671-680, XP055914810.

De Canniere Helene et al., "Wearable Monitoring and Interpretable Machine Learning Can Objectively Track Progression in Patients during Cardiac Rehabilitation", Sensors, vol. 20, No. 12, Jun. 26, 2020, XP055914617, pp. 1-15.

Boulanger Pierre et al., "A Low-cost Virtual Reality Bike for Remote Cardiac Rehabilitation", Dec. 7, 2017, Advances in Biometrics: International Conference, ICB 2007, Seoul, Korea, pp. 155-166.

Yin Chieh et al., "A Virtual Reality-Cycling Training System for Lower Limb Balance Improvement", BioMed Research International, vol. 2016, pp. 1-10.

Jennifer Bresnick, "What is the Role of Natural Language Processing in Healthcare?", pp. 1-7, published Aug. 18, 2016, retrieved on Feb. 1, 2022 from https://healthitanalytics.com/featu res/what-is-the-role-of-natural-language-processing-in-healthcare.

Alex Bellec, "Part-of-Speech tagging tutorial with the Keras Deep Learning library," pp. 1-16, published Mar. 27, 2018, retrieved on Feb. 1, 2022 from https://becominghuman.ai/part-of-speech-tagging-tutorial-with-the-keras-deep-learning-library-d7f93fa05537.

Kavita Ganesan, All you need to know about text preprocessing for NLP and Machine Learning, pp. 1-14, published Feb. 23, 2019, retrieved on Feb. 1, 2022 from https:// towardsdatascience.com/all-you-need-to-know-about-text-preprocessing-for-nlp-and-machine-learning-bcl c5765ff67.

Badreesh Shetty, "Natural Language Processing (NPL) for Machine Learning," pp. 1-13, published Nov. 24, 2018, retrieved on Feb. 1, 2022 from https://towardsdatascience. com/natural-language-processing-nlp-for-machine-learning-d44498845d5b.

FYSIOMED, 16983—Vario adjustable pedal arms, retrieved from timestamp of Jun. 7, 2017 from https://web.archive.org/web/20160607052632/https://www.fysiomed.com/en/products/16983-vario-adjustable-pedal-arms on Dec. 15, 2021, 4 pages.

HCL Fitness, HCI Fitness PhysioTrainer Pro, 2017, retrieved on Aug. 19, 2021, 7 pages, https://www.amazon.com/HCI-Fitness-PhysioTrainer-Electronically-Controlled/dp/B0759YMW78/.

HCL Fitness, HCI Fitness PhysioTrainer Upper Body Ergonometer, announced 2009 [online], retrieved on Aug. 19, 2021, 8 pages, www.amazon.com/HCI-Fitness-PhysioTrainer-Upper-Ergonometer/dp/B001 P5GUGM.

International Preliminary Report on Patentability of International Application No. PCT/US2017/50895, dated Dec. 11, 2018, 52 pages.

International Searching Authority, Search Report and Written Opinion for International Application No. PCT/US2017/50895, dated Jan. 12, 2018, 6 pages.

International Searching Authority, Search Report and Written Opinion for International Application No. PCT/US2020/021876, dated May 28, 2020, 8 pages.

Matrix, R3xm Recumbent Cycle, retrieved on Aug. 4, 2020, 7 pages, https://www.matrixfitness.com/en/cardio/cycles/r3xm-recumbent.

ROM3 Rehab, ROM3 Rehab System, Apr. 20, 2015, retrieved on Aug. 31, 2018, 12 pages, https://vimeo.com/125438463.

Barrett et al., "Artificial intelligence supported patient self-care in chronic heart failure: a paradigm shift from reactive to predictive, preventive and personalised care," EPMA Journal (2019), pp. 445-464.

Oerkild et al., "Home-based cardiac rehabilitation is an attractive alternative to no cardiac rehabilitation for elderly patients with coronary heart disease: results from a randomised clinical trial," BMJ Open Accessible Medical Research, Nov. 22, 2012, pp. 1-9.

Bravo-Escobar et al., "Effectiveness and safety of a home-based cardiac rehabilitation programme of mixed surveillance in patients with ischemic heart disease at moderate cardiovascular risk: A randomised, controlled clinical trial," BMC Cardiovascular Disorders, 2017, pp. 1-11, vol. 17:66.

Thomas et al., "Home-Based Cardiac Rehabilitation," Circulation, 2019, pp. e69-e89, vol. 140.

Thomas et al., "Home-Based Cardiac Rehabilitation," Journal of the American College of Cardiology, Nov. 1, 2019, pp. 133-153, vol. 74.

(56) References Cited

OTHER PUBLICATIONS

Thomas et al., "Home-Based Cardiac Rehabilitation," HHS Public Access, Oct. 2, 2020, pp. 1-39.
Dittus et al., "Exercise-Based Oncology Rehabilitation: Leveraging the Cardiac Rehabilitation Model," Journal of Cardiopulmonary Rehabilitation and Prevention, 2015, pp. 130-139, vol. 35.
Chen et al., "Home-based cardiac rehabilitation improves quality of life, aerobic capacity, and readmission rates in patients with chronic heart failure," Medicine, 2018, pp. 1-5 vol. 97:4.
Lima de Melo Ghisi et al., "A systematic review of patient education in cardiac patients: Do they increase knowledge and promote health behavior change?," Patient Education and Counseling, 2014, pp. 1-15.
Fang et al., "Use of Outpatient Cardiac Rehabilitation Among Heart Attack Survivors—20 States and the District of Columbia, 2013 and Four States, 2015," Morbidity and Mortality Weekly Report, vol. 66, No. 33, Aug. 25, 2017, pp. 869-873.
Beene et al., "AI and Care Delivery: Emerging Opportunities for Artificial Intelligence to Transform How Care Is Delivered," Nov. 2019, American Hospital Association, pp. 1-12.
Malloy, Online Article "AI-enabled EKGs find difference between numerical age and biological age significantly affects health, longevity", Website: https://newsnetwork.mayoclinic.org/discussion/ai-enabled-ekgs-find-difference-between-numerical-age-and-biological-age-significantly-affects-health-longevity/, Mayo Clinic News Network, May 20, 2021, retrieved: Jan. 23, 2023, p. 1-4.
Website for "Pedal Exerciser", p. 1, retrieved on Sep. 9, 2022 from https://www.vivehealth.com/collections/physical-therapy-equipment/products/pedalexerciser.
Website for "Functional Knee Brace with ROM", p. 1, retrieved on Sep. 9, 2022 from http://medicalbrace.gr/en/product/functional-knee-brace-with-goniometer-mbtelescopicknee/.
Website for "ComfySplints Goniometer Knee", pp. 1-5, retrieved on Sep. 9, 2022 from https://www.comfysplints.com/product/knee-splints/.
Website for "BMI FlexEze Knee Corrective Orthosis (KCO)", pp. 1-4, retrieved on Sep. 9, 2022 from https://orthobmi.com/products/bmi-flexeze%C2%AE-knee-corrective-orthosis-kco.
Website for "Neoprene Knee Brace with goniometer—Patella ROM MB.4070", pp. 1-4, retrieved on Sep. 9, 2022 from https://www.fortuna.com.gr/en/product/neoprene-knee-brace-with-goniometer-patella-rom-mb-4070/.
Kuiken et al., "Computerized Biofeedback Knee Goniometer: Acceptance and Effect on Exercise Behavior in Post-total Knee Arthroplasty Rehabilitation," Biomedical Engineering Faculty Research and Publications, 2004, pp. 1-10.
Ahmed et al., "Artificial intelligence with multi-functional machine learning platform development for better healthcare and precision medicine," Database, 2020, pp. 1-35.
Davenport et al., "The potential for artificial intelligence in healthcare," Digital Technology, Future Healthcare Journal, 2019, pp. 1-5, vol. 6, No. 2.
Website for "OxeFit XS1", pp. 1-3, retrieved on Sep. 9, 2022 from https://www.oxefit.com/xs1.
Website for "Preva Mobile", pp. 1-6, retrieved on Sep. 9, 2022 from https://www.precor.com/en-us/resources/introducing-preva-mobile.
Website for "J-Bike", pp. 1-3, retrieved on Sep. 9, 2022 from https://www.magneticdays.com/en/cycling-for-physical-rehabilitation.
Website for "Excy", pp. 1-12, retrieved on Sep. 9, 2022 from https://excy.com/portable-exercise-rehabilitation-excy-xcs-pro/.
Website for "OxeFit XP1", p. 1, retrieved on Sep. 9, 2022 from https://www.oxefit.com/xp1.
Jeong et al., "Computer-assisted upper extremity training using interactive biking exercise (iBikE) platform," Sep. 2012, pp. 1-5, 34th Annual International Conference of the IEEE EMBS.

* cited by examiner

SYSTEM, METHOD AND APPARATUS FOR ADJUSTABLE PEDAL CRANK

CROSS-REFERENCE TO RELATED APPLICATIONS

This application is a continuation of U.S. patent application Ser. No. 16/812,462, filed Mar. 9, 2020, which claims priority to and the benefit of U.S. Prov. Pat. App. No. 62/816,531, filed Mar. 11, 2019. The entire disclosures of the above-referenced applications are hereby incorporated by reference.

TECHNICAL FIELD

This application generally relates to adjustable exercise and/or rehabilitation equipment and, in particular, to a system, method and apparatus for an adjustable pedal crank.

STATEMENT OF FEDERALLY FUNDED RESEARCH

None.

BACKGROUND OF THE DISCLOSURE

Various devices are used by people for exercising and/or rehabilitating parts of their bodies. For example, to maintain a desired level of fitness, users may operate devices for a period of time as part of a workout regimen. In another example, a person may undergo knee surgery and a physician may provide a treatment plan for rehabilitation that includes operating a rehabilitation device for a period of time to strengthen and/or improve flexibility of parts of the body. The exercise and/or rehabilitation devices may include pedals on opposite sides. The devices may be operated by a user engaging the pedals with their feet or their hands and rotating the pedals. Although existing designs are workable, improvements in such equipment continue to be of interest.

SUMMARY OF THE DISCLOSURE

Embodiments of a system, method and apparatus fora pedal assembly for an exercise or rehabilitation device are disclosed. For example, the pedal assembly can include a crank having a hub with an axis of rotation. The crank can have a plurality of pedal apertures extending along a radial length of the crank. The crank can further include a locking plate that is slidably mounted to the crank. The locking plate can have a locked position wherein portions of the locking plate radially overlap portions of the pedal apertures, and an unlocked position wherein no portions of the locking plate radially overlap the pedal apertures. In addition, a pedal having a spindle can be interchangeably and releasably mounted to the pedal apertures in the crank.

Another embodiment of a pedal assembly for an exercise or rehabilitation device can include a disk having an axis of rotation. A central aperture can be formed in the disk along the axis. Spokes can extend radially from adjacent the central aperture toward a perimeter of the disk. The disk can be formed from a first material. In addition, a crank can be coupled to one of the spokes of the disk. The crank can have a hub concentric with the central aperture. Pedal apertures can extend along a radial length of the crank. The crank can be formed from a metallic material that differs from the first material. A pedal having a spindle can be interchangeably and releasably mounted to the pedal apertures in the crank.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description can be had by reference to the embodiments that are illustrated in the appended drawings. However, the drawings illustrate only some embodiments and are not to be considered limiting in scope since there can be other equally effective embodiments.

The use of the same reference symbols in different drawings indicates similar or identical items.

DETAILED DESCRIPTION OF THE DISCLOSURE

Figure 1:
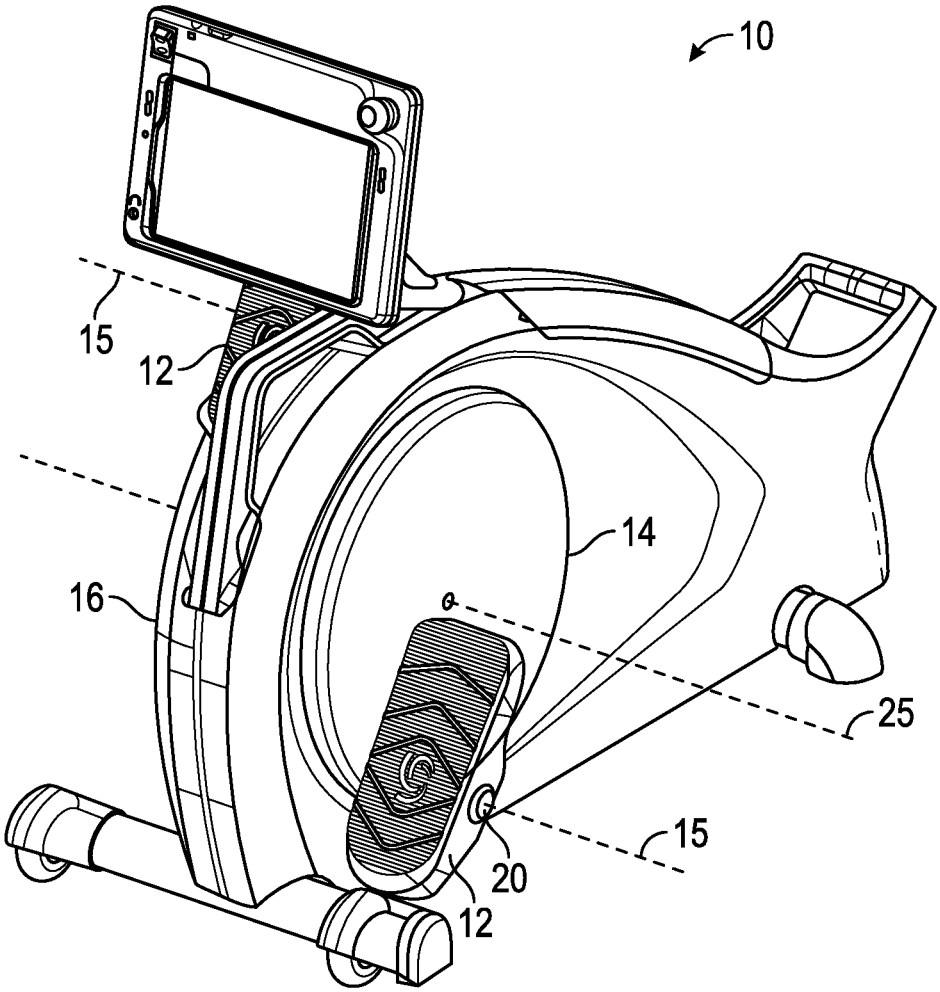
FIG. 1 is a schematic isometric view of an embodiment of an adjustable rehabilitation or exercise device.

U.S. Pat. No. 10,173,094, issued on Jan. 8, 2019, to Gomberg, et al., is incorporated herein by reference in its entirety.

FIGS. 1-6 depict various embodiments of a system, method and apparatus for a pedal assembly for a rehabilitation or exercise device. With initial reference to FIG. 1, there is shown an adjustable rehabilitation and/or exercise device 10 having patient engagement members, such as pedals 12 on opposite sides. The pedals 12 can be adjustably positioned relative to one another, but securely mounted to avoid disconnection, wobbling and the like experienced with some conventional devices.

Versions of the device 10 can include a rotary device such as a wheel 14 or flywheel or the like, rotatably mounted such as by a hub to a body or frame 16 or other support. The pedals 12 can be configured for interacting with a patient for exercise or rehabilitation. The pedals 12 can be configured for use with lower body extremities such as the feet or legs, or upper body extremities such as the hands, arms and the like. The pedals 12 can be a conventional bicycle pedal of the type having a foot support rotatably mounted onto an axle 20 with bearings. The axle 20 can have exposed end threads for engaging a mount on the wheel 14 to locate the pedal 12 on the wheel 14. The wheel 14 can be configured to have both pedals 12 on opposite sides of a single wheel. However, FIGS. 1A and 1B show a pair of the wheels 14 spaced apart from one another but interconnected to other components.

Embodiments of the rehabilitation and/or exercise device 10 of FIGS. 1A-1B can take the form as depicted, which can be portable. Alternatively, it can be non-portable such that it remains in a fixed location (e.g., at a rehabilitation clinic or medical practice). The device 10 can be configured to be a smaller and more portable unit so that it can be easily transported to different locations at which rehabilitation or treatment is to be provided, such as the homes of patients, alternative care facilities or the like.

Figure 2:
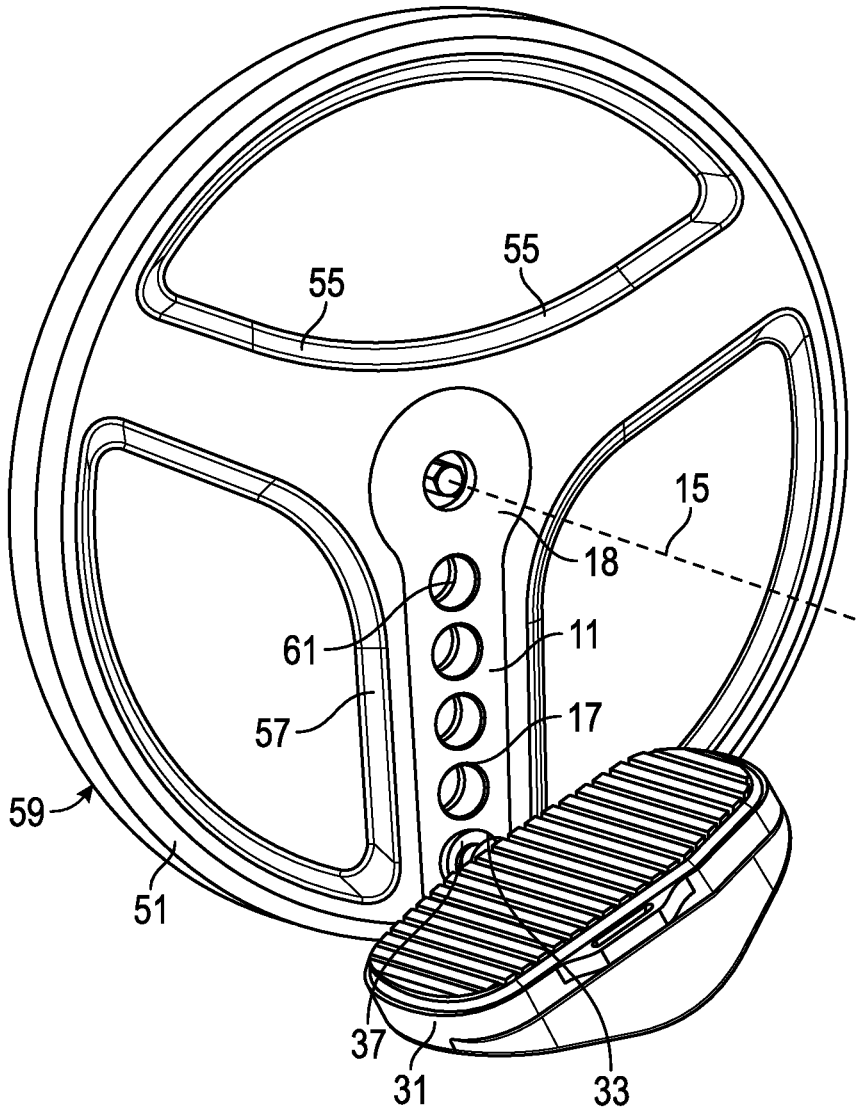
FIG. 2 is an isometric view of an embodiment of a pedal crank.
Figure 3:
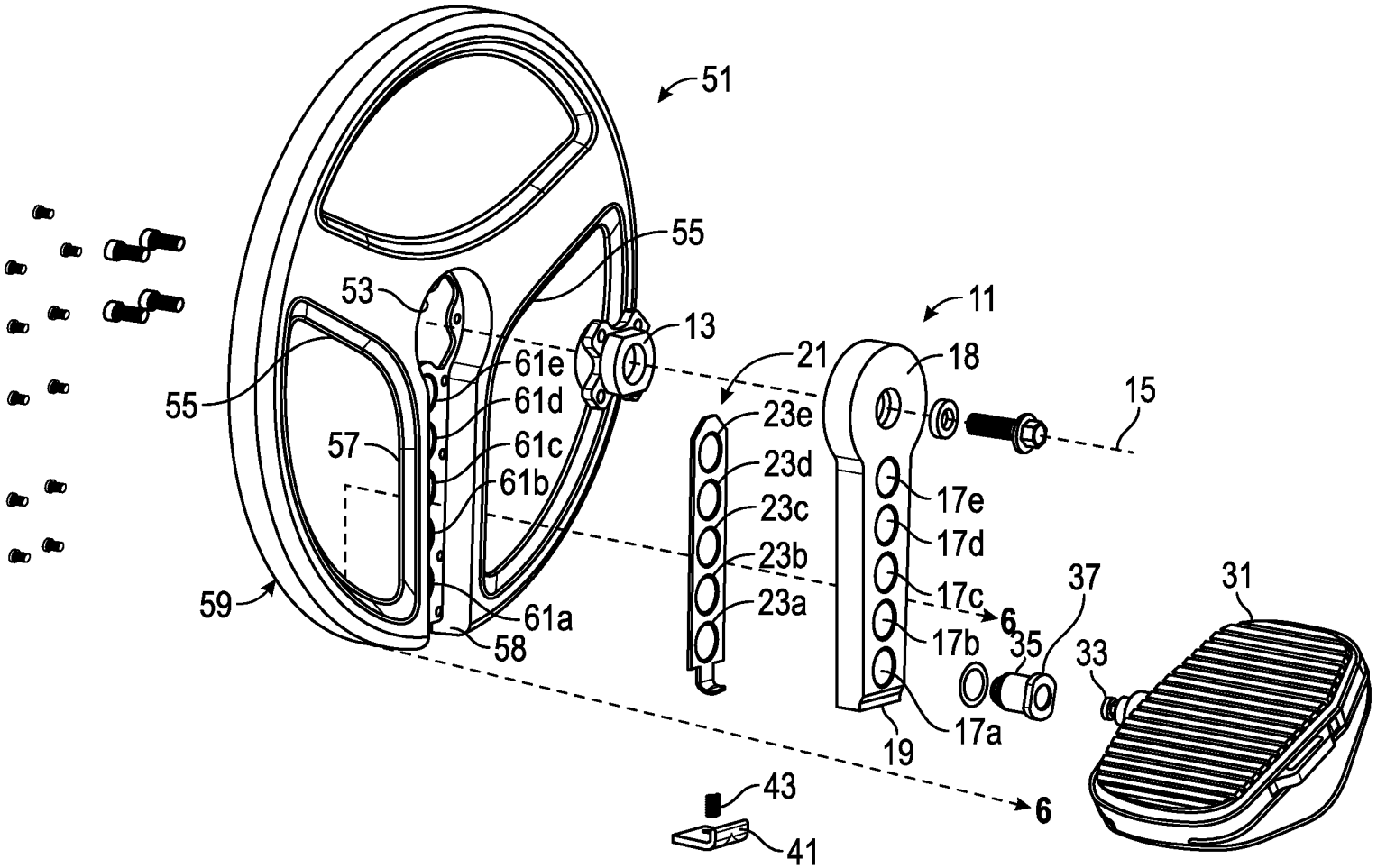
FIG. 3 is an exploded, isometric view of an embodiment of a pedal crank.

FIGS. 2 and 3 depict an embodiment of a pedal assembly including a disk 51 having an axis 15 of rotation. The disk 51 can include a central aperture 53 along the axis 15. A plurality of spokes 55, 57 can extend radially from adjacent the central aperture 53 toward a perimeter 59 of the disk 51. The disk 51 can be formed from a first material, such as a polymer. In one example, the polymer can comprise acrylonitrile butadiene styrene (ABS).

The pedal assembly can further include a crank 11. Examples of the crank 11 can be coupled to one of the spokes 57 of the disk 51. In some versions, only one of the spokes 57 of the disk 51 comprises a radial slot 58 (FIG. 3). Other ones of the spokes 55 of the disk 51 may or may not comprise a radial slot 58. The crank 11 can be mounted in the radial slot 58, as illustrated.

In some examples, the crank 11 can comprise a hub 13 that is concentric with the central aperture 53. The hub 13 can be detachable from the crank 11. The central aperture 53 can be complementary in shape to the hub 13, as shown. The crank 11 can be formed from a metallic material that differs from the first material used to form the disk 51. For example, the crank can comprise stainless steel 440C.

Figure 4:
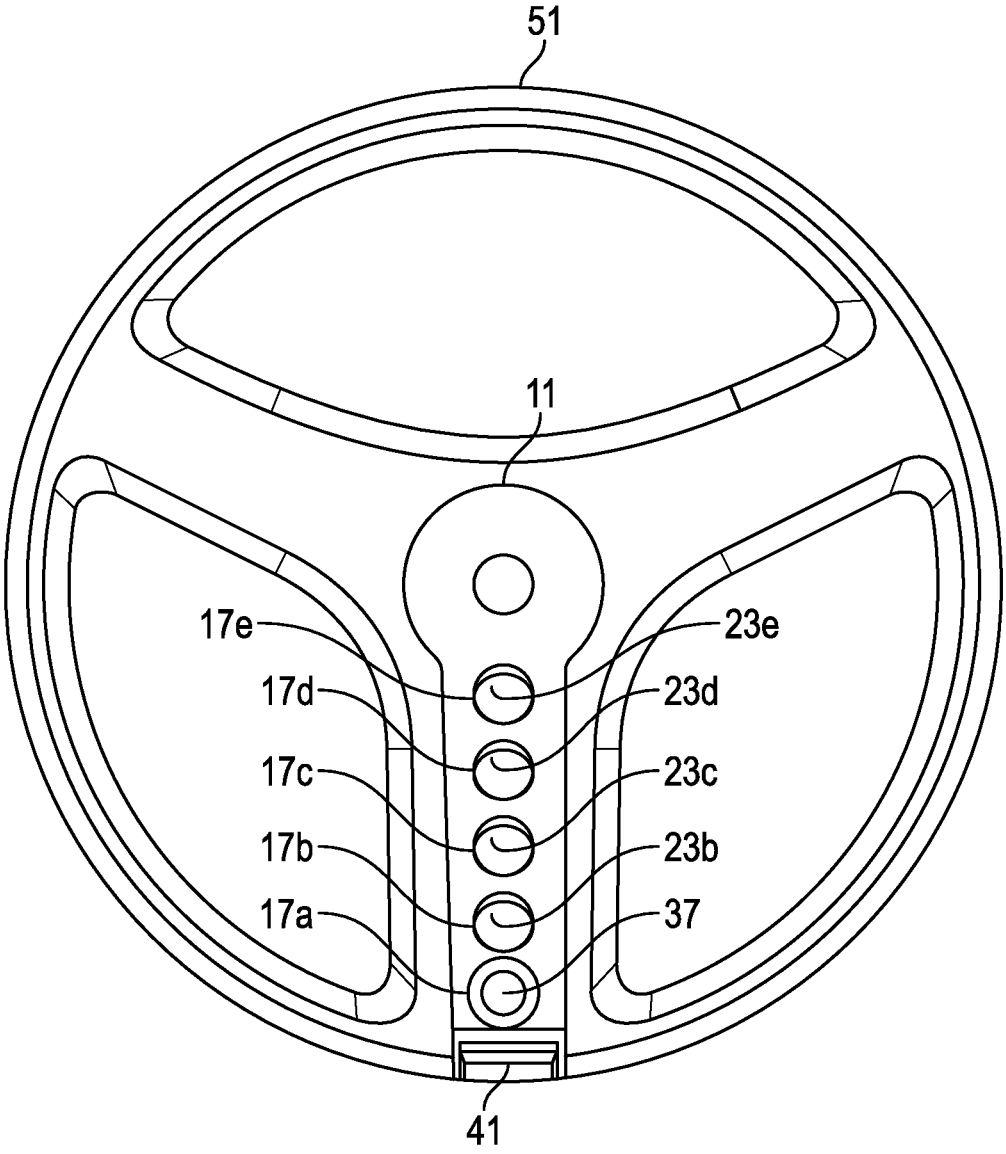
FIG. 4 is an axial view of an embodiment of a pedal crank.
Figure 5:
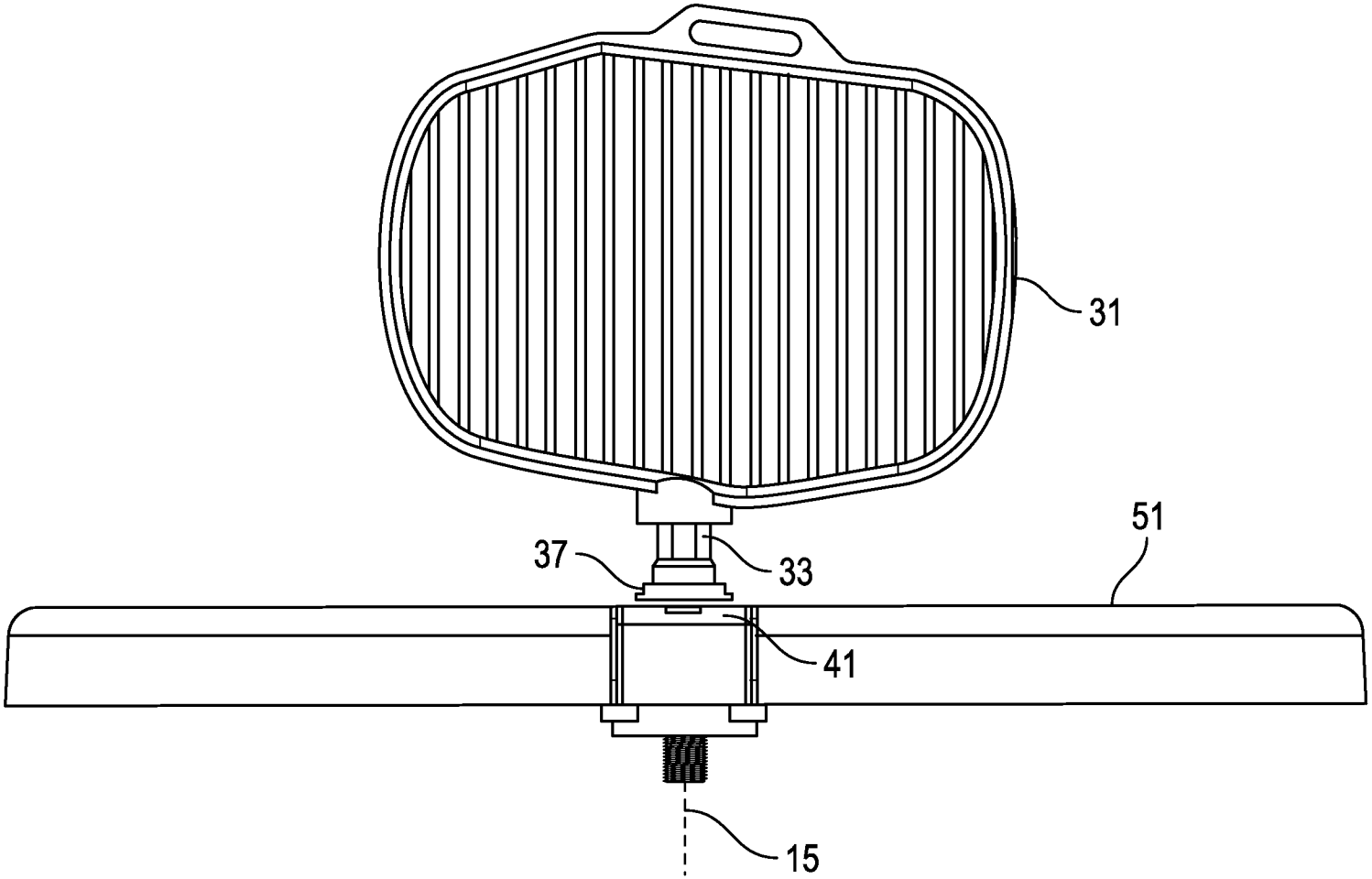
FIG. 5 is a radial view of an embodiment of a pedal crank.
Figure 6A:
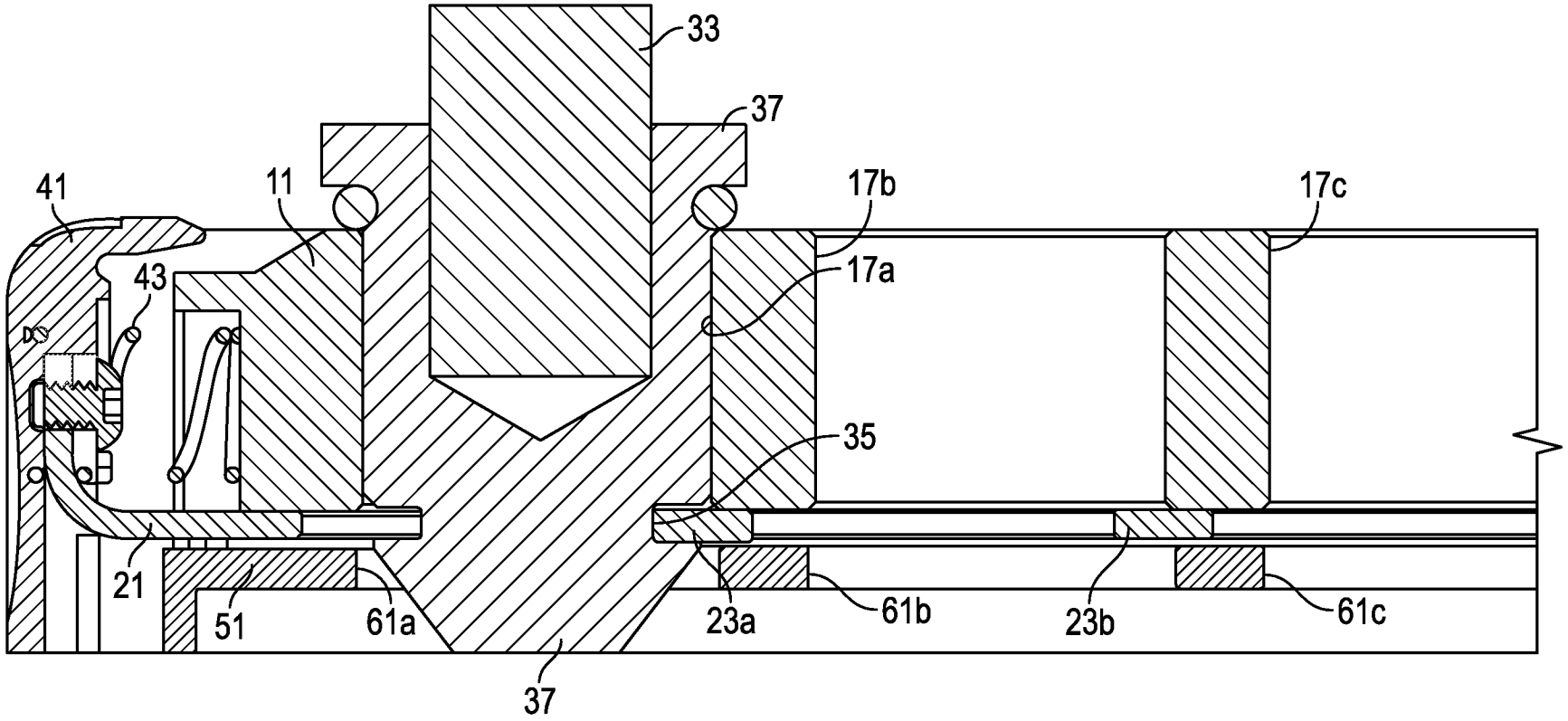
FIG. 6A is a sectional view of a portion of the pedal crank of FIG. 3, taken along the dashed line 6-6 in FIG. 3, with the lock plate in a default locked position.
Figure 6B:
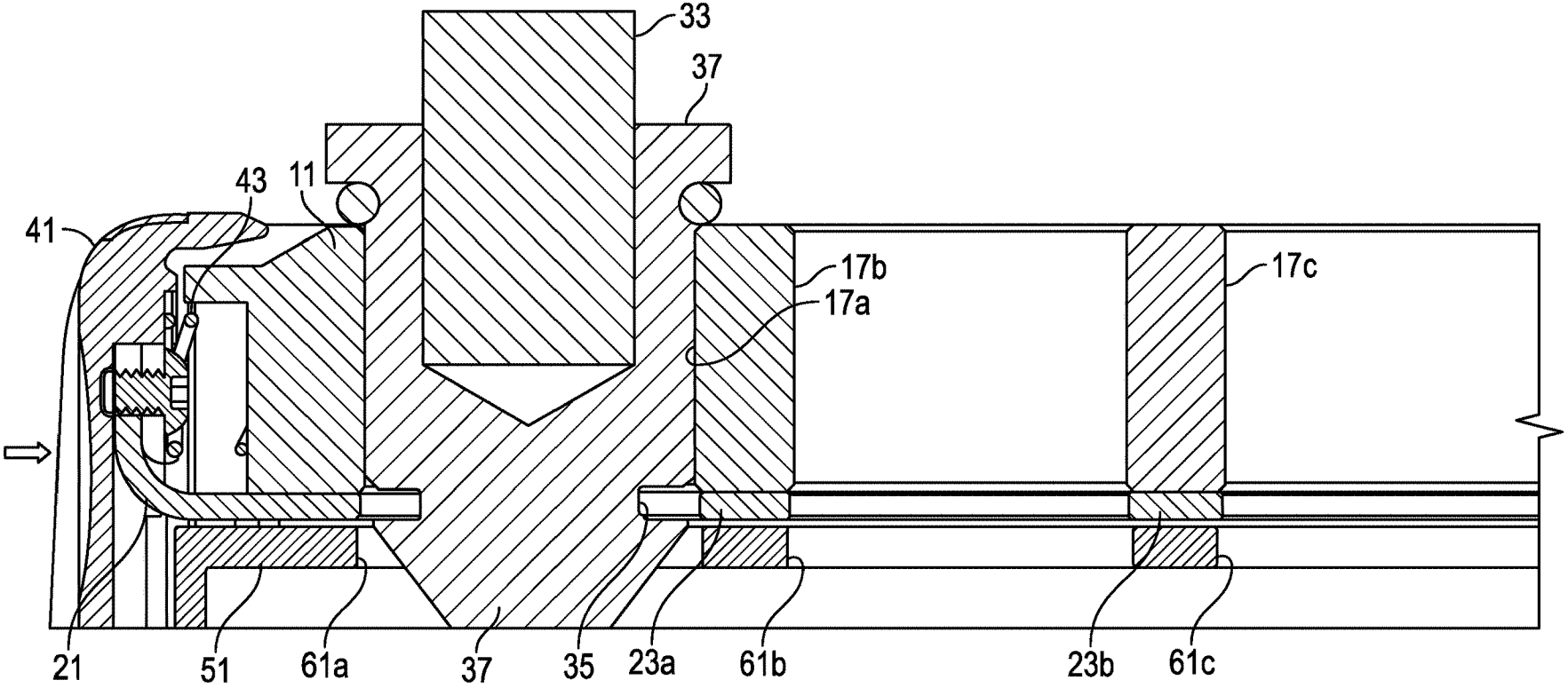
FIG. 6B is a sectional view of a portion of the pedal crank of FIG. 3, taken along the dashed line 6-6 in FIG. 3, with the lock plate in an unlocked position.

Embodiments of the crank 11 can include a plurality of holes or pedal apertures 17*a*-17*e* (FIGS. 3, 4, 6A and 6B) extending along a radial length of the crank 11. Although five pedal apertures 17*a*-17*e* are illustrated, the crank could have fewer or more of them. As shown in FIGS. 2 and 5, a pedal 31 can be coupled to the crank 11 via a spindle 33. The pedal 31 can be configured to be interchangeably and releasably mounted to the pedal apertures 17*a*-17*e* in the crank 11. In addition, the disk 51 can include holes of disk pedal apertures 61*a*-61*e* (FIGS. 3, 6A and 6B). The disk pedal apertures 61*a*-61*e* can be coaxial and not obstructed (i.e., unobstructed) by respective ones of the pedal apertures 17*a*-17*e* of the crank 11. In some versions, the disk 51 can be solid, other than at the central aperture 53, disk pedal apertures 61*a*-61*e* and the fastener apertures as shown in the drawings.

Versions of the pedal assembly can include the crank 11 with a locking plate 21 (FIG. 3). The locking plate 21 can be slidably mounted to the crank 11. As shown in FIGS. 4 and 6A, examples of the locking plate 21 can include a locked position (FIG. 4) wherein portions 23*a*-23*e* of the locking plate radially overlap portions of the pedal apertures 17*a*-17*e* (and, e.g., the disk pedal apertures 61*a*-61*e*). In some versions (compare FIG. 6B), the locking plate 21 can include an unlocked position (FIG. 2) wherein no portions of the locking plate 21 radially overlap the pedal apertures 17*a*-17*e* (and, e.g., the disk pedal apertures 61*a*-61*e*).

In some embodiments, when moving between the locked and unlocked positions, the portions 23*a*-23*e* of the locking plate 21 can simultaneously overlap and retract from the pedal apertures 17*a*-17*e* (and, e.g., the disk pedal apertures 61*a*-61*e*). The term "simultaneous" can be defined and understood as including less than perfect, mathematically precise, identical movements, such as substantially or effectively simultaneous. In the unlocked position, examples of the disk pedal apertures 61*a*-61*e* can be coaxial and not obstructed (i.e., unobstructed) by the portions 23*a*-23*e* of the locking plate 21 of the crank 11.

As shown in FIGS. 2 and 3, some examples of the pedal assembly can include the spindle 33 having a circumferential slot 35 (FIGS. 6A and 6B) for selectively engaging the portions 23*a*-23*e* of the locking plate 21 adjacent to the pedal apertures 17*a*-17*e*. In one version, the circumferential slot 35 can be formed in a pedal pin 37 that is mounted to the spindle 33.

Embodiments of the locking plate 21 can default to the locked position. In one version, the locking plate 21 can default to the locked position by spring bias against the crank 11. For example, the locking plate 21 can include a plunger 41 (FIGS. 3, 6A and 6B) that can be actuated by a spring 43 adjacent to a radial perimeter 19 of the crank 11.

Still other versions can include one or more of the following embodiments.

1. A pedal assembly for an exercise and rehabilitation device, the pedal assembly comprising:

a crank having a hub with an axis of rotation, a plurality of pedal apertures extending along a radial length of the crank, and a locking plate that is slidably mounted to the crank, the locking plate having a locked position wherein portions of the locking plate radially overlap portions of the pedal apertures, and an unlocked position wherein no portions of the locking plate radially overlap the pedal apertures; and a pedal having a spindle configured to be interchangeably and releasably mounted to the pedal apertures in the crank.

2. The pedal assembly of any of these embodiments wherein, when moving between the locked and unlocked positions, the portions of the locking plate simultaneously overlap and retract from the pedal apertures, respectively.

3. The pedal assembly of any of these embodiments, wherein the locking plate defaults to the locked position by spring bias against the crank.

4. The pedal assembly of any of these embodiments, further comprising a plunger and a spring for actuating the locking plate adjacent a radial perimeter of the crank.

5. The pedal assembly of any of these embodiments, wherein the spindle comprises a circumferential slot for selectively engaging the locking plate adjacent to the pedal apertures.

6. The pedal assembly of any of these embodiments, wherein the circumferential slot is formed in a pedal pin that is mounted to the spindle.

7. The pedal assembly of any of these embodiments, further comprising a disk coaxial with the axis of rotation, a central aperture along the axis and a plurality of spokes extending radially from adjacent the central aperture toward a perimeter of the disk, and the disk is formed from a different material than the crank; and the crank is coupled to one of the spokes of the disk.

8. The pedal assembly of any of these embodiments, wherein the disk has disk pedal apertures that are coaxial and not obstructed by the pedal apertures of the crank; and the crank is mounted in a radial slot of one of the spokes.

9. A pedal assembly for an exercise and rehabilitation device, the pedal assembly comprising:

a disk having an axis of rotation, a central aperture along the axis and a plurality of spokes extending radially from adjacent the central aperture toward a perimeter of the disk, and the disk is formed from a first material; and a crank coupled to one of the spokes of the disk, the crank having a hub concentric with the central aperture, and a plurality of pedal apertures extending along a radial length of the crank, and the crank is formed from a metallic material that differs from the first material; and a pedal having a spindle configured to be interchangeably and releasably mounted to the pedal apertures in the crank.

10. The pedal assembly of any of these embodiments, wherein the disk has disk pedal apertures that are coaxial and not obstructed by the pedal apertures of the crank.

11. The pedal assembly of any of these embodiments, wherein the first material comprises a polymer.

12. The pedal assembly of any of these embodiments, wherein only one of the spokes of the disk comprises a radial slot, the crank is mounted in the radial slot, and other ones of the spokes of the disk do not comprise a radial slot.

13. The pedal assembly of any of these embodiments, wherein the central aperture is complementary in shape to the hub, and the hub is detachable from the crank.

14. The pedal assembly of any of these embodiments, wherein the disk is solid other than at the central aperture, disk pedal apertures and fastener apertures.

15. The pedal assembly of any of these embodiments, wherein the crank comprises a locking plate that is slidably mounted to the crank, the locking plate having a locked position wherein portions of the locking plate radially overlap portions of the pedal apertures, and an unlocked position wherein no portions of the locking plate radially overlap the pedal apertures.

16. The pedal assembly of any of these embodiments wherein, when moving between the locked and unlocked positions, the portions of the locking plate simultaneously overlap and retract from the pedal apertures, respectively.

17. The pedal assembly of any of these embodiments, wherein the locking plate defaults to the locked position by spring bias against the crank.

18. The pedal assembly of any of these embodiments, further comprising a plunger for spring actuating the locking plate adjacent a radial perimeter of the crank.

19. The pedal assembly of any of these embodiments, wherein the spindle comprises a circumferential slot for selectively engaging the locking plate adjacent to the pedal apertures.

20. The pedal assembly of any of these embodiments, wherein the circumferential slot is formed in a pedal pin that is mounted to the spindle.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed is not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. A pedal assembly for an exercise and rehabilitation device, the pedal assembly comprising:

a crank having a hub with an axis of rotation, pedal apertures extending along a radial length of the crank, and a locking plate that is slidably mounted to the crank, the locking plate has a locked position wherein portions of the locking plate radially overlap portions of the pedal apertures, and an unlocked position wherein no portions of the locking plate radially overlap the pedal apertures; and a pedal having a spindle configured to be interchangeably and releasably mounted to the pedal apertures in the crank; and wherein when moving between the locked and unlocked positions, the portions of the locking plate simultaneously radially overlap and retract relative to the pedal apertures, respectively.

2. The pedal assembly of claim 1, wherein the locking plate defaults to the locked position by spring bias against the crank.

3. The pedal assembly of claim 2, further comprising a plunger and a spring for actuating the locking plate adjacent a radial outer perimeter of the crank.

4. The pedal assembly of claim 1, wherein the spindle comprises a circumferential slot for selectively engaging the locking plate adjacent to the pedal apertures.

5. The pedal assembly of claim 4, wherein the circumferential slot is formed in a pedal pin that is mounted to the spindle.

6. The pedal assembly of claim 1, further comprising a disk coaxial with the axis of rotation, a central aperture along the axis and a plurality of spokes extending radially from adjacent the central aperture toward a perimeter of the disk, and the disk is formed from a different material than the crank; and the crank is coupled to one of the spokes of the disk.

7. The pedal assembly of claim 5, wherein the disk has disk pedal apertures that are coaxial and not obstructed by the pedal apertures of the crank; and the crank is mounted in a radial slot of one of the spokes.

8. A pedal assembly for an exercise and rehabilitation device, the pedal assembly comprising:

a disk having an axis of rotation, a central aperture along the axis and spokes extending radially from adjacent the central aperture toward a perimeter of the disk, and disk pedal apertures, the disk is formed from a first material; and a crank coupled to one of the spokes of the disk, the crank having a hub concentric with the central aperture, and pedal apertures extending along a radial length of the crank, the disk pedal apertures are coaxial and not obstructed by the pedal apertures of the crank, and the crank is formed from a metallic material that differs from the first material; and a pedal having a spindle configured to be interchangeably and releasably mounted to the pedal apertures in the crank.

9. The pedal assembly of claim 8, wherein the first material comprises a polymer.

10. The pedal assembly of claim 8, wherein only one of the spokes of the disk comprises a radial slot, the crank is mounted in the radial slot and other ones of the spokes of the disk do not comprise a radial slot.

11. A pedal assembly for an exercise and rehabilitation device, the pedal assembly comprising:

a disk having an axis of rotation, a central aperture along the axis and spokes extending radially from adjacent the central aperture toward a perimeter of the disk, and the disk is formed from a first material; and a crank coupled to one of the spokes of the disk, the crank having a hub concentric with the central aperture, the central aperture is complementary in shape to the hub, and the hub is detachable from the crank, and pedal apertures extending along a radial length of the crank, and the crank is formed from a metallic material that differs from the first material; and a pedal having a spindle configured to be interchangeably and releasably mounted to the pedal apertures in the crank.

12. The pedal assembly of claim 8, wherein the disk is solid other than at the central aperture, disk pedal apertures and fastener apertures.

13. The pedal assembly of claim 8, wherein the crank comprises a locking plate that is slidably mounted to the crank, the locking plate having a locked position wherein portions of the locking plate radially overlap portions of the pedal apertures, and an unlocked position wherein no portions of the locking plate radially overlap the pedal apertures.

14. The pedal assembly of claim 13 wherein, when moving between the locked and unlocked positions, the portions of the locking plate simultaneously radially overlap and retract relative to the pedal apertures, respectively.

15. The pedal assembly of claim 13, wherein the locking plate defaults to the locked position by spring bias against the crank.

16. The pedal assembly of claim 15, further comprising a plunger for spring actuating the locking plate adjacent a radial perimeter of the crank.

17. The pedal assembly of claim 13, wherein the spindle comprises a circumferential slot for selectively engaging the locking plate adjacent to the pedal apertures.

18. The pedal assembly of claim 17, wherein the circumferential slot is formed in a pedal pin that is mounted to the spindle.

* * * * *